US005472199A

United States Patent [19]

Rainey

[11] Patent Number: 5,472,199

[45] Date of Patent: Dec. 5, 1995

[54] INDIVIDUALLY COLLECTIBLE PUZZLE PINS

[76] Inventor: Rodd B. Rainey, 158 S. Cleveland Ave., Mogadore, Ohio 44260

[21] Appl. No.: 218,351

[22] Filed: Mar. 28, 1994

[51] Int. Cl.[6] ..... A63F 9/10

[52] U.S. Cl. ..... 273/156; 273/157 R

[58] Field of Search ..... 273/156, 157 R, 273/157 A

[56] References Cited

U.S. PATENT DOCUMENTS

| | | | |
|---|---|---|---|
| 142,338 | 9/1973 | Higgins | 273/157 R |
| D. 333,494 | 2/1993 | Fagan | D71/104 |
| 1,276,344 | 8/1918 | Gilman | 273/157 R X |
| 1,415,245 | 5/1922 | Kennedy | 273/157 R |
| 1,570,906 | 1/1926 | McCord | 273/157 R X |
| 3,181,869 | 5/1965 | Genin | 273/157 R |
| 3,512,780 | 5/1970 | Allison | 273/139 |
| 3,949,506 | 4/1976 | Benkowski | 40/160 |
| 4,050,698 | 9/1977 | Brown | 273/157 R X |
| 4,053,159 | 10/1977 | Kulak | 273/157 R |
| 4,177,305 | 12/1979 | Feingold | 428/13 |
| 4,756,533 | 7/1988 | Hopkins | 273/157 R |
| 5,232,088 | 8/1993 | Leondidis | 206/223 |

*Primary Examiner*—William H. Grieb
*Attorney, Agent, or Firm*—Oldham & Oldham, Co.

[57] ABSTRACT

A puzzle comprises a set of puzzle pieces and a mounting board for mounting the pieces. Each puzzle piece has an essentially planar body with a front surface, an opposing rear surface and a periphery. The front surface has first and second characteristic ornamentations on it. The first characteristic ornamentation provides the puzzle piece with unique individual value, particularly display value. The second characteristic ornamentation provides a portion of an overall pictorial image farmable from the set of puzzle pieces. Each piece is shaped to be placed adjacent to at least one other piece of the set so that when all of the set pieces are placed in a unique spatial arrangement, the overall pictorial image is formed. The rear surface is provided with a means for fastening the piece to an article, allowing individual or set display. The fastening means can include a pin, a strip of adhesive material, a strip of magnetic material or the like. The periphery of the pieces may be shaped so as to interlock with adjacent pieces when the pieces are in the unique spatial arrangement.

34 Claims, 3 Drawing Sheets

INDIVIDUALLY COLLECTIBLE PUZZLE PINS

The present invention relates to a set of collectible pins, each of which possesses inherent individual value for collecting and which, as a group, may be placed adjacent to the others in the manner of puzzle pieces to form an overall pictorial image. The present invention further relates to a dissected puzzle comprising such a set of individually collectible puzzle piece pins and a display board.

BACKGROUND ART

In recent years, it has become fashionable to collect pins, particularly pins indicating that the wearer has an association with or attended specific events. For example, pins are used as promotional items at baseball games, they are openly and widely traded at the Olympic Games, etc. In the pins known generally in the prior art, the entire intrinsic value of the pin is due to certain characteristic ornamentations on the pin itself. For example, in the baseball context, the pin may show the logo of an All-Star Game. In another example, the pin may show the logo of a corporate sponsor and certain indicia or ornamentations that represent an event, such as the Olympic Games. In many of these prior art situations, the pins are not necessarily individual, since the issuer of the pins may have a series of different pins available. However, the pins themselves do not interact with each other in any manner. As a result, if the pins are collected together and displayed simultaneously, they really present nothing more than the indication that the owner has successfully completed the set. In fact, unless one knows exactly how many pins are available in the set, it is not inherently obvious to an observer whether the collector has obtained the entire set.

SUMMARY OF THE INVENTION

It is, therefore, a first object of the present invention to provide a set of ornamental devices, specifically collectible pins, where each pin is decorated with a first set of characteristic ornamentations that impart inherent individual collection value to the pin, but also includes a second set of characteristic ornamentations that forms a portion of an overall pictorial image. The overall pictorial image is achieved only when one of each of the set of puzzle pins is obtained and the individual pins are spatially arranged in a unique pattern as to form the overall pictorial image in the form of a puzzle.

This and other objects of the invention are achieved by a puzzle comprising a set of puzzle pieces and a mounting board for fastening the second surface of lo each puzzle piece. The puzzle pieces comprise an essentially planar body with first and second surface and a periphery. The first surface has first and second characteristic ornamentations on it. The first characteristic ornamentation provides the individual puzzle piece with unique individual value, particularly display value. The second characteristic ornamentation provides a portion of an overall pictorial image that is formed when the entire set of puzzle pieces are positioned in a unique spatial arrangement. The periphery of each puzzle piece is shaped for being placed adjacent to at least one other piece of the set of puzzle pieces when the set of pieces are positioned in the unique spatial arrangement. The second surface of each puzzle piece is provided with means for fastening the puzzle piece to an article. In some embodiments, the periphery of each puzzle piece is shaped so as to interlock with at least one other piece of the set of puzzle pieces when the set of pieces are positioned in the unique spatial arrangement. The preferred material for the body of the puzzle pieces is metal, particularly brass. In the preferred embodiment, the first and second characteristic ornamentations are painted onto the first surface, particularly with a fired enamel paint. The means for fastening on the second surface may be a pin, a strip of pressure sensitive adhesive, a strip of magnetized material, or the like.

BRIEF DESCRIPTION OF THE DRAWINGS

The present invention is best understood when reference is made to the accompanying drawings, which are made a part hereof, in which identical parts are indicated by identical part numbers, and in which.

DETAILED DESCRIPTION OF THE DRAWINGS

Figure 1:
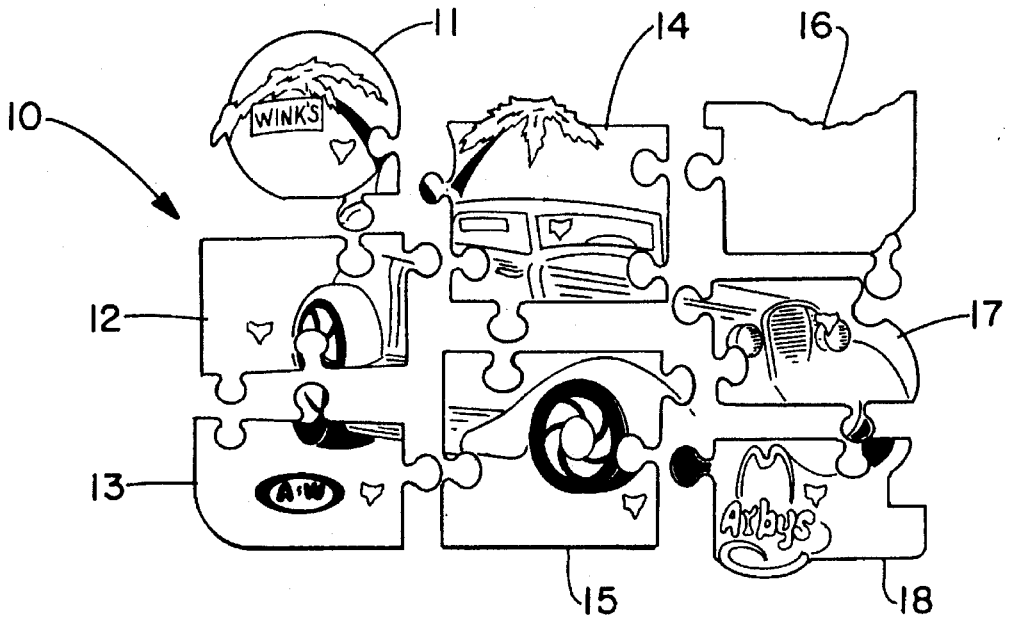
FIG. 1 shows a front elevational view of a first embodiment set of individually collectible puzzle pins of the present invention, wherein the individual pieces are not in interlocking relationship.

A first embodiment set 10 of collectible pins of the present invention is presented in spaced-apart front elevational view in FIG. 1. The set 10 comprises a plurality of individual pins, numbered as 11 through 18. The specific set 10 of pins 11–18 comprises eight pins, although the number of pins could be as low as two and still accomplish the intended purposes of the invention. It is clear from FIG. 1 that the number of pins in the set 10 could be much larger than the eight pins shown in FIG. I and still achieve the intended purpose. As best seen in FIGS. 3 and 4–7, which isolate and focus on details of individual pin 17, each pin 11–18 is an essentially planar body 20 having a first surface 22 and an opposing second surface 24. Because the pin body 20 is essentially planar, its thickness in relation to its height and width is generally quite small, although the thickness is not so small as to prevent the pin body 20 from retaining its rigidity. The pin body 20 is typically formed from metal and most typically from a metal such as brass. The exact selection of the metal to be used is within the discretion of the manufacturer. The pin body 20 certainly can be formed from other metals that would be used for their ornamental value, such as silver, gold, copper, titanium, platinum and the like. However, the more precious metals would tend to be used only when the pins would have a high value in and of themselves. Polymeric materials and other materials can certainly be selected, but generally these materials would not have the inherent collectible value possessed by a metallic pin. Since the pin body 20 is essentially planar, there is a periphery 26 surrounding the first and second surfaces 22 and 24, respectively, that can be formed in any of a variety of shapes. Two factors influence the shape of the periphery 26 of the individual pin 11–18. The first factor is the portion of the periphery 26 that will form an external border of the overall puzzle formed when the individual pins 11–18 are formed into a pictorial image. This portion of the periphery 26 is therefore the border portion of the periphery and it will be shaped to provide a portion of the overall border of the pictorial image. The second factor is the relationship of the individual puzzle pin to the other puzzle pins of the set 10. The portion of the periphery 26 that is going to be placed adjacent to the other puzzle pieces is referred to as the internal periphery of the pin. As is well known with puzzles, particularly jigsaw puzzles, the matching of the internal periphery of a first puzzle piece with a corresponding portion of the internal periphery of an additional puzzle piece, as well as matching of the characteristic ornamentation on the front surface 22 of the pin hopefully provides the puzzle solver with sufficient clues to arrange the individual puzzle pieces into the unique spacial arrangement where an overall pictorial image is presented by all of the puzzle pieces. In this particular puzzle, the individual pieces just happen to be pins 11–18 of the set 10. When the characteristic ornamentations on the front surfaces 22 of the individual pins is matched in this manner and the peripheries 26 are arranged, the result is a set 10 of collectible pins that form a recognizable overall pictorial image 28, as is shown in FIG. 2.

Figure 2:
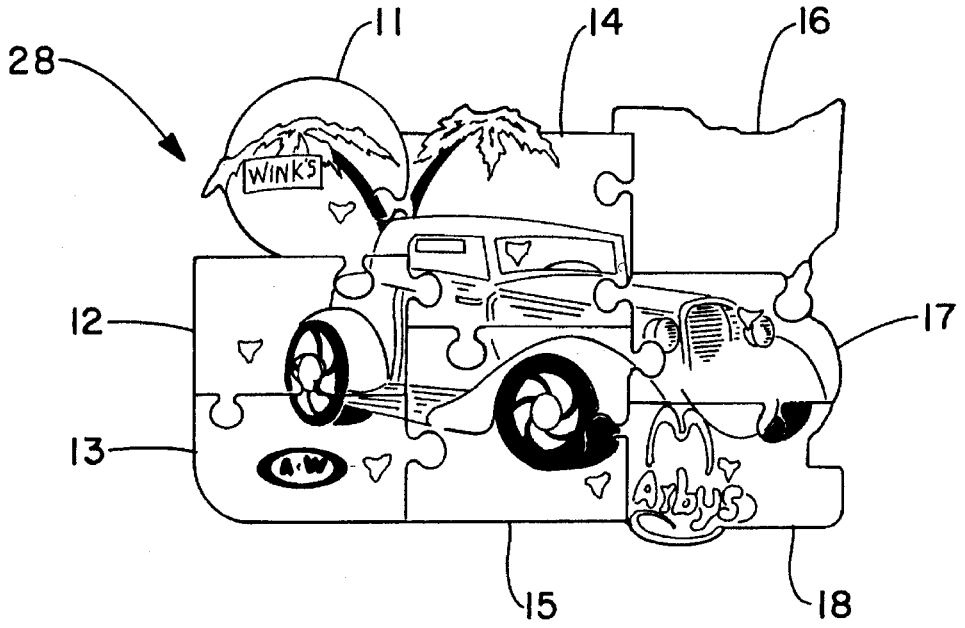
FIG. 2 shows a front elevational view of the first embodiment set of puzzle pins, placed in interlocking relationship.
Figure 3:
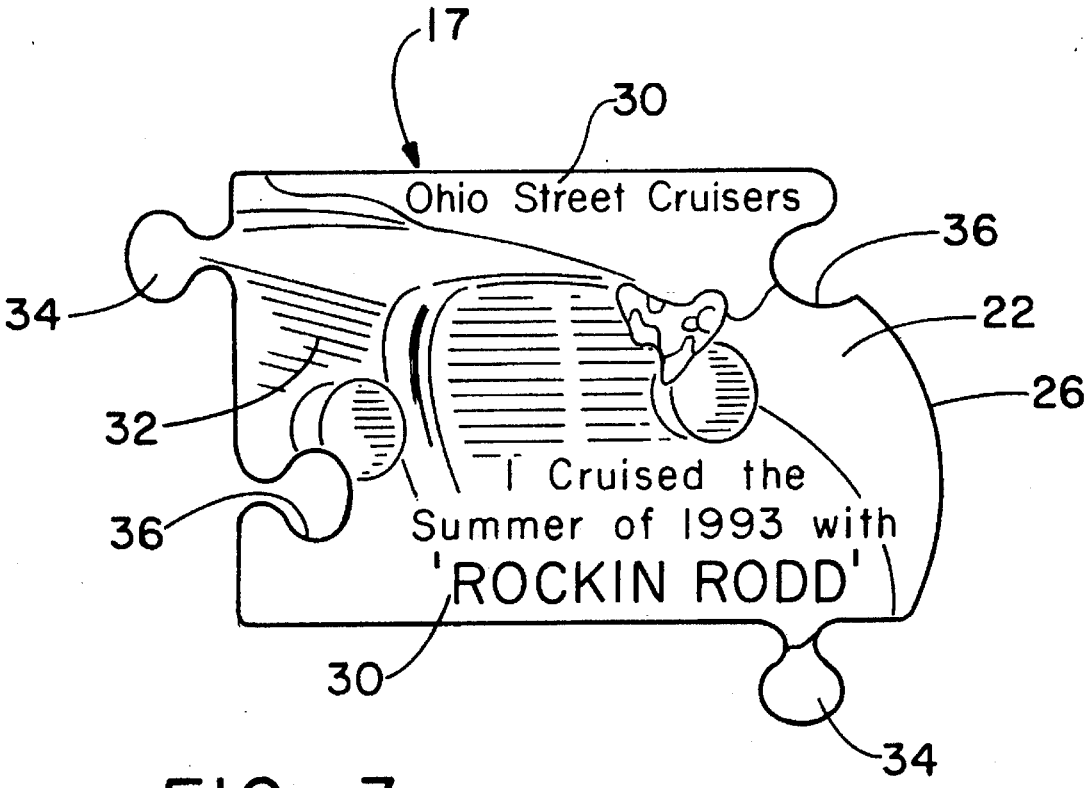
FIG. 3 shows a front elevational view of an individual pin of the present invention.

Further attention is now directed to FIG. 3, where the individual pin 17 from the set 10 has been isolated and shown in clearer detail. The first surface 22 has two distinctive types of characteristic ornamentation placed on it. The first type 30 of ornamentation is characteristic ornamentation that provides inherent value or decorative value to the individual pin 17 standing by itself. For example, this first type 30 of ornamentation can consist of written and/or pictorial indicia such as a logo, a date of an event, a location of an event, or the like. In FIG. 3, the first type 30 of ornamentation on individual pin 17 is characterized by the words "I cruised the Summer of 1993 with 'ROCKIN RODD'", and the words "Ohio Street Cruisers." This first type 30 of characteristic ornamentation will tend to cover only a portion of the first surface 22. The second type 32 of characteristic ornamentation on the pin 17 is generally provided as an overall background to the first type 30 of characteristic ornamentation. The second type 32 of characteristic ornamentation is generally a portion of the overall pictorial image 28 that is assembled by assembling each of the individual puzzle pins in proper spatial relationship. For example, the portion of the front end and grille section of an automobile shown in the pin 17 is the second type 32 of characteristic ornamentation. The shape of the periphery 26 of the puzzle pin 17 as well as drawings or the like are used to present the second type 32 of characteristic ornamentation. In the specific examples shown in FIGS. 1 and 2 but not detailed in FIG. 3, the first type 30 of characteristic ornamentation can also be the logo and name of a particular drive-in restaurant that participated in a "cruise-in", which is a social event where owners of muscle cars and other vintage autos drive through the drive-in on a particular day. Specific examples of this are shown in individual pins 11, 13 and 18 in FIGS. 1 and 2. Each pin 11–18 has the first type 30 of characteristic ornamentation, although it is not necessary shown in each pin, due to the drawing size requirements. The secondary type 32 of characteristic ornamentation on each individual pin 11–18 is a portion of the overall picture 28 that presents an image of a vintage auto set against a setting sun with a pair of palm trees and an outline map of the state of Ohio.

The manner in which the first type 30 and second type 32 of characteristic ornamentation is applied may be varied from one set of pins to another. In the particular case, the characteristic ornamentation is achieved through raised metallic surface lettering on the otherwise flat planar surface, in combination with painting of the first surface, particularly painting of the surface with a fired enamel type of paint. Use of such fired enamel paint is well known in the art of ornamental pins. In practice, the preferred method of placing the characteristic ornamentations on the individual pins will result in a end product that is reminiscent of the old technique known as cloisonne.

In each of the individual puzzle pins 11–18 shown in FIGS. 1–3, but as best seen in FIG. 3, the internal periphery 26 of the pin is provided with at least one male interlocking projection 34 and at least one female interlocking recess 36. Certainly the desired result may be achieved by having at least one interlocking means, be it male or female, for each pin with which the individual pin is meant to interact, although a second embodiment described below uses abutment of pins rather than interlocking to achieve the same result. Through the use of this interlocking technique, which is well-known in jigsaw puzzles, the individual pins 11–18 can actually be interlocked with the other pins in the set 10 to form the overall pictorial image 28.

Figure 4:
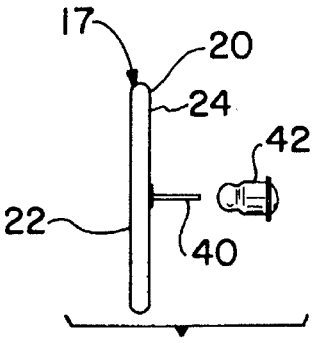
FIG. 4 shows a top plan view of an individual pin of the present invention showing a first fastening means.
Figure 5:
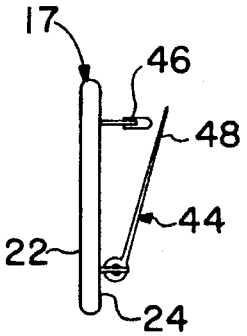
FIG. 5 shows a top plan view of an individual pin of the present invention showing a second fastening means.
Figure 6:
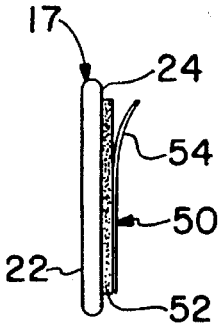
FIG. 6 shows a top plan view of an individual pin of the present invention showing a third fastening means.
Figure 7:
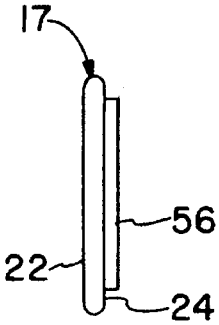
FIG. 7 shows a top plan view of an individual pin of the present invention showing a fourth fastening means.

Attention is now directed to the rear surface 24 of the individual puzzle pin 17 of FIG. 3, as best illustrated in top plan view in FIGS. 4–7. This opposing second or rear surface 24 of the pin 17 is provided with a means for fastening so that the pin 17 may be fastened to an article. Since the type of article the pin 17 would be attached to will vary, from clothing articles to dashboards of vehicles to refrigerators or other metallic surfaces, just to name a few, there are clear variations in the means for fastening used. FIG. 4 presents a first means for fastening. This is a "stick pin" type of fastener 40 that would project perpendicularly from the second surface 24 and terminate in a sharp point, which can be covered with a post type cover 42. This type of fastening means would be used to affix the pin 17 to an article of clothing such as a lapel, a shirt, a cap or hat, or the like. FIG. 5 shows a second means for fastening. This is a latched pin 44 that runs generally parallel to the second surface 24 of the pin 17 and has a latch 46 to affix the open end 48 thereof. This second type of fastening means would also be used for attaching the pin 17 to an article of clothing or the like. FIG. 6 shows the third type of fastener. This is a short strip 50 of adhesive material such as a pressure sensitive adhesive. In the preferred embodiment of this means of fastening, the strip 50 would be a short strip of foamed polymeric material 52 having opposing first and second surfaces. The first surface would have a permanent adhesive on it for affixing the strip 50 to the second surface 24 of the pin 17. The second surface of the fastener strip 50 would have a pressure sensitive adhesive on it and the adhesive would be covered with a release liner sheet 54. When the release liner sheet 54 is removed, the pressure sensitive adhesive layer would be exposed and could be used for fastening the pin 17 to the dashboard of an automobile, a refrigerator, or a display board. FIG. 7 shows an even further means of fastening. This is a thin strip of magnetic material 56, preferably flexible magnetic material. This strip 56 of material would be adhered through a standard adhesive to the rear surface 24 of the pin 17 and it would use its magnetic capability to adhere the pin to a suitable ferromagnetic surface, such as is found on a refrigerator or a metallic display board. Of course, other fastening means are well known in the art and could be applied to the invention by persons of skill in this art.

Figure 8:
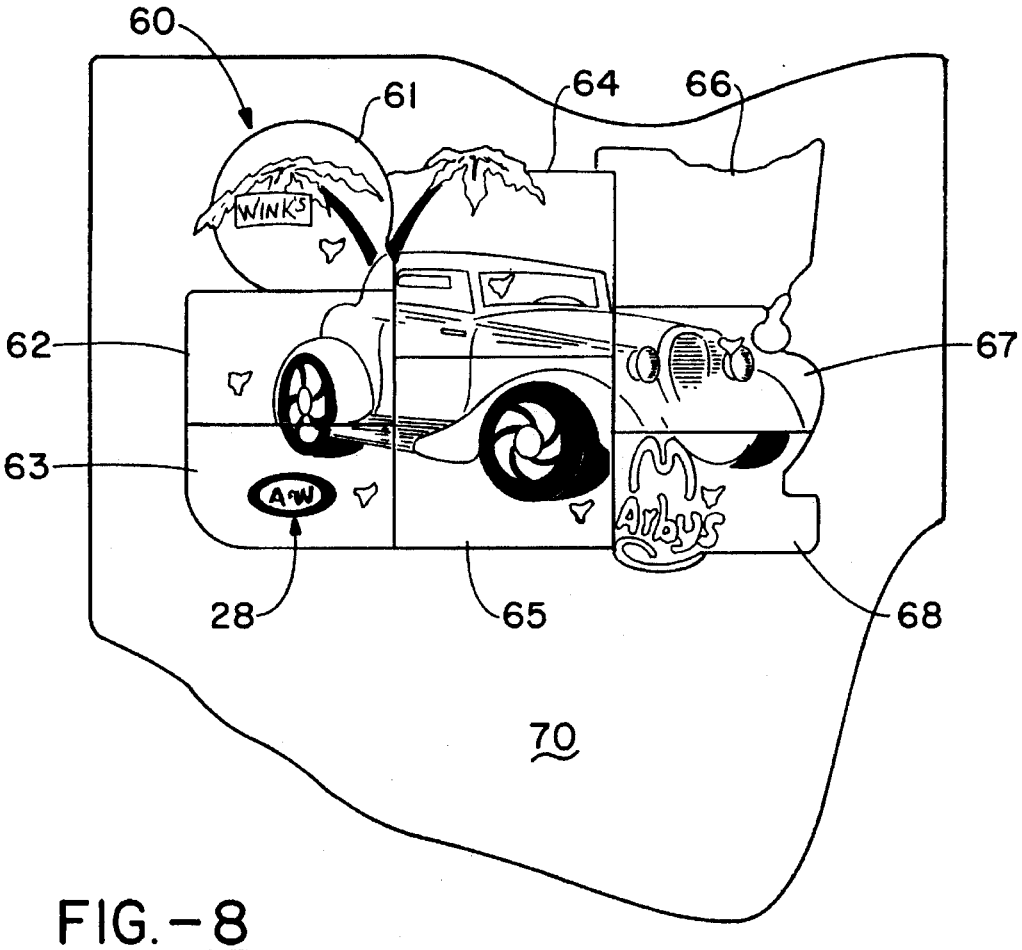
FIG. 8 shows a front elevational view of a second embodiment set of puzzle pins of the present invention, mounted on a display board.

FIG. 8 shows a second embodiment set 60 of individually collectible pins 61–68 of the present invention arranged in the spatial relationship that gives the overall pictorial image from the second characteristic ornamentations. In this second set 60 of pins 61–68, the pins are shown displayed on a display board 70 that could be provided to persons participating in the promotional event. The display board 70 would have appropriately positioned cut-outs or hollows to receive the fastening means, but the actual means of affixing the individual pins 61–68 to the display board would be preferably a pressure sensitive adhesive strip of the type shown in FIG. 6 and the accompanying text. While the first embodiment set 10 of pins 11–18 shows the individual puzzle pins to have internal periphery portions possessing interlockable elements 34 and 36, the use of interlockable elements is not essential to the invention. By means of shape and the visual continuity of the overall pictorial image 28 as developed from the second type of characteristic ornamentations on the individuals pins 61–68, the individual puzzle pins can be formed so that the individual pins do not need to interlock with each other. Instead, each individual pin is positioned in abutting relationship to at least one other pin so that the overall pictorial image 28 is formed. As illustrated in FIG. 8, the same overall pictorial image presented in FIG. 2 can be presented by eight individual puzzle pins 61–68 where the internal periphery sections of the individual pins lack the interlocking elements 34 and 36 present in FIG. 2.

While the specific examples of the present invention has been taught in relationship to an advertising campaign in association with a "cruise-in", the applications of the present invention are certainly not limited thereto. Important applications of the present invention would be associated with sporting events. For example, a series of pins could be designed in association with a single event such as a World Series or an All-Star Game so that the individual pins, when fitted together, would present the logo of that particular game as the overall pictorial image. The individual pins would each carry as the first characteristic ornamentation the identifying logo or indicia of a corporate sponsor, a broadcasting network, or the like. Similar applications are found in association with football games, particularly bowl games and/or professional Super Bowl contests. Also, applications would be found in association with international sporting events such as the Olympics. Likewise, the individual pins could represent a series of individual promotions, such as a series of individual pins that depict an overall pictorial image of a team mascot, a depiction of a new stadium, or the like.

In the examples described herein, none of the individual pins is described as having intrinsic value or collectible value substantially greater than that of any other of the individual pins. However, there are applications where one or more of the pins could be produced or distributed in significantly lower quantity than the others. In such a case, which would typically be used in association with a contest or the like, the lower quantity would result in higher demand and therefore higher intrinsic value for parties seeking to collect the entire series or set.

While this invention has been described in detail with reference to specific embodiments in compliance with statute, it shall be understood that various other modifications in addition to those mentioned can be made by persons skilled in the art without departing from the scope and spirit of this invention.

What is claimed is:

1. A puzzle comprising:

a set of puzzle pieces, each said puzzle piece comprising an essentially planar body with a first surface, an opposing second surface and a periphery; each said first surface having first and second characteristic ornamentations thereon; said first characteristic ornamentation providing said puzzle piece with unique individual value and said second characteristic ornamentation providing a portion of an overall pictorial image formable from all of the set of puzzle pieces; the periphery of each said puzzle piece being shaped so as to interlock with the periphery of at least one other puzzle piece of the set such that when all of the puzzle pieces are placed in a unique spatial arrangement the second characteristic ornamentations on the puzzle pieces form the overall pictorial image; said second surface provided with means for fastening each said puzzle piece to an article; and a mounting board for fastening the second surface of each said puzzle piece in overall pictorial image forming position.

2. The puzzle of claim 1 wherein the means for fastening on each said puzzle piece is a pin.

3. The puzzle of claim 1 wherein the means for fastening on each said puzzle piece is a strip of pressure sensitive adhesive.

4. The puzzle of claim 1 wherein the means for fastening on each said puzzle piece is a strip of magnetized material.

5. A puzzle comprising:

a set of puzzle pieces, each said puzzle piece comprising an essentially planar metallic body with a first surface, an opposing second surface and a periphery; each said first surface having first and second characteristic ornamentations thereon; said first characteristic ornamentation providing said puzzle piece with unique individual value and said second characteristic ornamentation providing a portion of an overall pictorial image formable from all of the set of puzzle pieces; each said puzzle piece being shaped to be placed adjacent to at least one other said puzzle piece of the set such that when all of the puzzle pieces are placed in a unique spatial arrangement the second characteristic ornamentations on the puzzle pieces form the overall pictorial image; said second surface provided with means for fastening each said puzzle piece to an article; and a mounting board for fastening the second surface of each said puzzle piece in overall pictorial image forming position.

6. The puzzle of claim 3 wherein the metal is brass.

7. The puzzle of claim 1 wherein the first and second characteristic ornamentations are painted onto the first surface.

8. The puzzle of claim 7 wherein the paint is fired enamel.

9. The puzzle of claim 5 wherein the mounting board is wood.

10. The puzzle of claim 5 wherein the means for fastening on each said puzzle piece is a pin.

11. The puzzle of claim 5 wherein the means for fastening on each said puzzle piece is a strip of pressure sensitive adhesive.

12. The puzzle of claim 5 wherein the means for fastening on each said puzzle piece is a strip of magnetized material.

13. A set of puzzle pieces, each of said puzzle pieces comprising an essentially planar body with a first surface, an opposing second surface and a periphery; said first surface having first and second characteristic ornamentations thereon; said first characteristic ornamentation providing said puzzle piece with unique individual value and said second characteristic ornamentation providing a portion of an overall pictorial image formable from all of the set of puzzle pieces; and said second surface provided with means for fastening said puzzle piece to an article; the periphery of each said puzzle piece being shaped so as to interlock with the periphery of at least one other puzzle piece of the set such that when all of the puzzle pieces are placed in a unique spatial arrangement the second characteristic ornamentations on the puzzle pieces form the overall pictorial image; said second surface provided with means for fastening each said puzzle piece to an article.

14. The set of puzzle pieces of claim 13 wherein the means for fastening on each said puzzle piece is a pin.

15. The set of puzzle pieces of claim 13 wherein the means for fastening on each said puzzle piece is a strip of pressure sensitive adhesive.

16. The set of puzzle pieces of claim 13 wherein the means for fastening on each said puzzle piece is a strip of magnetized material.

17. A set of puzzle pieces, each said puzzle piece comprising an essentially planar metallic body with a first surface, an opposing second surface and a periphery; each said first surface having first and second characteristic ornamentations thereon; said first characteristic ornamentation providing said puzzle piece with unique individual value and said second characteristic ornamentation providing a portion of an overall pictorial image formable from all of the set of puzzle pieces; each said puzzle piece being shaped to be placed adjacent to at least one other said puzzle piece of the set such that when all of the puzzle pieces are placed in a unique spatial arrangement the second characteristic ornamentations on the puzzle pieces form the overall pictorial image; said second surface provided with means for fastening each said puzzle piece to an article.

18. The set of puzzle pieces of claim 17 wherein the metal is brass.

19. The set of puzzle pieces of claim 17 wherein the first and second characteristic ornamentations are painted onto the first surface.

20. The set of puzzle pieces of claim 19 wherein the paint is fired enamel.

21. The set of puzzle pieces of claim 17 wherein the means for fastening on each said puzzle piece is a pin.

22. The set of puzzle pieces of claim 17 wherein the means for fastening on each said puzzle piece is a strip of pressure sensitive adhesive.

23. The set of puzzle pieces of claim 17 wherein the means for fastening on each said puzzle piece is a strip of magnetized material.

24. An ornamental device comprising:

an essentially planar body with a first surface, an opposing second surface and a periphery;

said first surface having first and second characteristic ornamentations thereon;

said first characteristic ornamentation providing the ornamental device with unique individual ornamental value and said second characteristic ornamentation providing a portion of an overall pictorial image formable from a unique spatial arrangement of all of a set of said ornamental devices;

wherein the periphery of said ornamental device is shaped to interlock with at least one other said ornamental device of said set such that when all of the ornamental device of the set are placed in the unique spatial arrangement the second characteristic ornamentations form the overall pictorial image; and said second surface provided with means for fastening said ornamental device to an article.

25. The ornamental device of claim 24 wherein the means for fastening is a pin.

26. The ornamental device of claim 24 wherein the means for fastening is a strip of pressure sensitive adhesive.

27. The ornamental device of claim 24 wherein the means for fastening is a strip of magnetized material.

28. An ornamental device comprising:

an essentially planar metallic body with a first surface, an opposing second surface and a periphery;

said first surface having first and second characteristic ornamentations thereon;

said first characteristic ornamentation providing the ornamental device with unique individual ornamental value and said second characteristic ornamentation providing a portion of an overall pictorial image formable from a unique spatial arrangement of all of a set of said ornamental devices;

wherein the periphery of said ornamental device is shaped to be placed adjacent to at least one other said ornamental device of said set such that when all of the ornamental device of the set are placed in the unique spatial arrangement the second characteristic ornamentations form the overall pictorial image; and said second surface provided with means for fastening said ornamental device to an article.

29. The ornamental device of claim 18 wherein the metal is brass.

30. The ornamental device of claim 28 wherein the first and second characteristic ornamentations are painted onto the first surface.

31. The ornamental device of claim 30 wherein the paint is fired enamel.

32. The ornamental device of claim 28 wherein the means for fastening is a pin.

33. The ornamental device of claim 28 wherein the means for fastening is a strip of pressure sensitive adhesive.

34. The ornamental device of claim 28 wherein the means for fastening is a strip of magnetized material.

* * * * *